US006990919B1

(12) United States Patent
Calinawan

(10) Patent No.: US 6,990,919 B1
(45) Date of Patent: Jan. 31, 2006

(54) ATTACHMENT TO A SEA SCOOTER

(76) Inventor: Mel Calinawan, 3245 Coral Way, Marina, CA (US) 93933

( * ) Notice: Subject to any disclaimer, the term of this patent is extended or adjusted under 35 U.S.C. 154(b) by 0 days.

(21) Appl. No.: 11/045,049

(22) Filed: Jan. 31, 2005

(51) Int. Cl.
*B63C 11/46* (2006.01)

(52) U.S. Cl. ..... 114/315; 114/242

(58) Field of Classification Search ..... 114/315, 114/242
See application file for complete search history.

(56) References Cited

U.S. PATENT DOCUMENTS

| | | | | |
|---|---|---|---|---|
| 3,420,202 | A * | 1/1969 | Oversmith | 114/315 |
| 3,442,240 | A * | 5/1969 | Loughman et al. | 114/315 |
| 3,584,594 | A | 6/1971 | Poutout | |
| 3,890,920 | A | 6/1975 | Buelk | |
| 4,149,483 | A | 4/1979 | Scott, Jr. | |
| 4,813,367 | A | 3/1989 | Stevenson | |
| 4,864,959 | A | 9/1989 | Takamizawa et al. | |
| 5,024,178 | A | 6/1991 | Bruce | |
| 5,105,753 | A * | 4/1992 | Chih et al. | 114/315 |
| D347,418 | S | 5/1994 | De Santis et al. | |
| 2001/0025594 | A1 | 10/2001 | Daniels | |

FOREIGN PATENT DOCUMENTS

| | | |
|---|---|---|
| FR | 2 625 684 A1 | 7/1989 |
| GB | 2 271 935 A1 | 5/1994 |
| WO | 93/23119 | 11/1993 |

OTHER PUBLICATIONS

"Great American Outfitters", website: http://www.greatamericanoutfitters.com/SearchResult.aspx?CategoryID=22, 2 pages, printed from the Internet on Dec. 14, 2004.
"Sea Scooter", website: http://www.seascooter.net/ , 1 page, printed from the Internet on Dec. 14, 2004.

* cited by examiner

*Primary Examiner*—Jesus D. Sotelo
(74) *Attorney, Agent, or Firm*—Richard C. Litman

(57) ABSTRACT

The attachment to a sea scooter is a device that allows for safer, more stable use of a sea scooter. The central component of the attachment to a sea scooter is a clamp having a split ring to secure around a sea scooter. On both sides of the clamp are wings having stirrups for the attachment of pivoting arms. Attached to each of the arms is a pair of removable hollow poles that are pivotally connected to a pair of floats. Each float has a post with a pennant attached to it. One of the hollow poles may be equipped with a flexible breathing tube. The flexible breathing tube extends through the post, down through the hollow pole, and then exits the pole. A wheeled frame attached below the clamp allows a user to easily transport the attachment when not in use.

14 Claims, 5 Drawing Sheets

ATTACHMENT TO A SEA SCOOTER

BACKGROUND OF THE INVENTION

1. Field of the Invention

The present invention relates to floatation devices, and particularly to an attachment to a sea scooter that provides the sea scooter with more stability and safety in use.

2. Description of the Related Art

Sea scooters are small aquatic propulsion devices utilized by swimmers, divers, and those engaged in snorkeling. A typical sea scooter is driven by a battery-powered propeller and is capable of moving a user through the water at speeds up to three knots. Sea scooters are usually designed in the shape of a torpedo and are equipped with handgrips. However, sea scooters do have some marked disadvantages. If a swimmer releases their sea scooter while in the water, the scooter is liable to float away or sink. As a sea scooter allows a diver to rapidly descend into the water, inexperienced divers may find themselves going too deep into the water when using a sea scooter. Once removed from the water, some sea scooters may be too heavy to comfortably carry manually. Further, a swimmer using a sea scooter may propel himself or herself to a considerable distance from the shore, only to have the batteries fail, and lack the strength to return to the shore.

Several devices have been proposed to address problems associated with sea scooters. French Patent 2,625,684, published Jul. 13, 1989, describes a propulsion device for a swimmer featuring three floats attached to a frame. International Patent No. WO 93/23119, published Nov. 25, 1993, shows an individual underwater propulsion means using a reaction propulsion system. United Kingdom Patent No. 2,271,935, published May 4, 1994, discloses a motorized propulsion unit for underwater use that may be placed on a user's back.

None of the above patents and publications, taken either singly or together, is seen to describe the present invention. Thus, an attachment to a sea scooter solving the aforementioned problems is desired.

SUMMARY OF THE INVENTION

The attachment to a sea scooter is a device that allows for safer, more stable use of a sea scooter. The central component of the attachment to a sea scooter is a clamp having a split ring. A sea scooter is placed within the split ring. Each end of the split ring has a flange to allow the ends of the split ring to be clamped together. Wings extend from each side of the split ring and have stirrups for the attachment of pivoting arms. Attached to each of the arms is a pair of removable, hollow poles. The first end of each pole is connected to the arm and the second end of each pole is pivotally connected to a float. Each float has an upwardly extending post with a pennant attached to it. In order to increase stability of the poles, the two poles are connected by a support wire.

In one embodiment, one of the hollow poles is equipped with a flexible breathing tube. The flexible breathing tube runs through the post, down through the hollow pole, and then extends out of the pole so that a user may attach a snorkel to the flexible breathing tube. This allows a diver to snorkel to a deeper depth than conventional equipment allows. Other features of the attachment for a sea scooter include a wheeled frame attached below the clamp. The wheeled frame has two wheels and a handle that allows a user to easily transport the attachment to a sea scooter when not in use in the water.

When a user operates a sea scooter in conjunction with the attachment for a sea scooter, the user may regulate the depth. When a user is coasting along the surface, the poles are close to being horizontal to the surface of the water and trail behind the user. As a user descends in to the water, the poles pivot upwards until they are in a vertical position. Once the poles have reached the vertical position the floats prevent the user from going any deeper. In the event of an emergency where a swimmer becomes disoriented, the user could use the poles to climb back to the surface of the water. If, for any reason, the diver should abandon the sea scooter, the scooter may be located later by the position of the floats.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
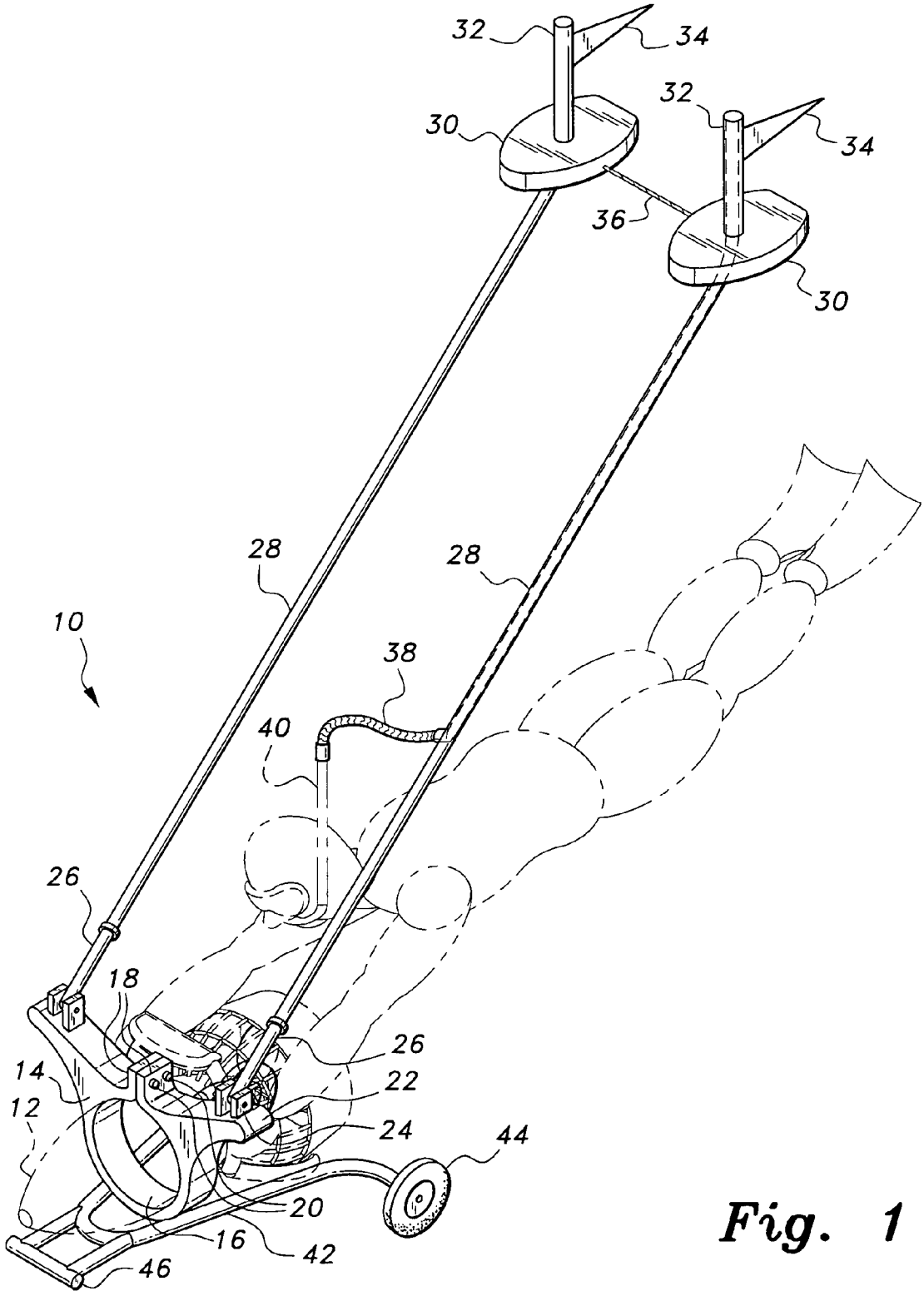
FIG. 1 is an environmental, perspective view of an attachment to a sea scooter according to the present invention.

The present invention is an attachment to a sea scooter, designated generally as 10 in the drawings and referred to as the "attachment" herein. Most sea scooters 12 are battery-powered portable units having the shape of a torpedo with attached handholds. As shown in FIG. 1, the attachment 10 is designed to be used in conjunction with a typical sea scooter 12 having a circular cross section.

The central component of the attachment 10 is a clamp 14 having a split ring 16. A sea scooter 12 is placed within the split ring 16. Each end of the split ring 16 has a flange 18 to allow the ends of the split ring 16 to be secured together by bolts 20, thus holding the sea scooter 12 within the split ring 16. Wings 22 extend to each side of the split ring 16 and have stirrups 24 for the attachment of pivoting arms 26. The pivoting arms 26 may alternatively be attached to the wings 22 through the use of hinges or other types of pivotal attaching means. Attached to each of the pivoting arms 26 is a pole 28 having a first end and a second end. The poles 28 are removably attached to the pivoting arms 26 at their first end. The poles 28 may be threaded onto the arms 26, swage fit onto the arms 26, or held to the arms 26 in some other suitable manner.

Figure 4:
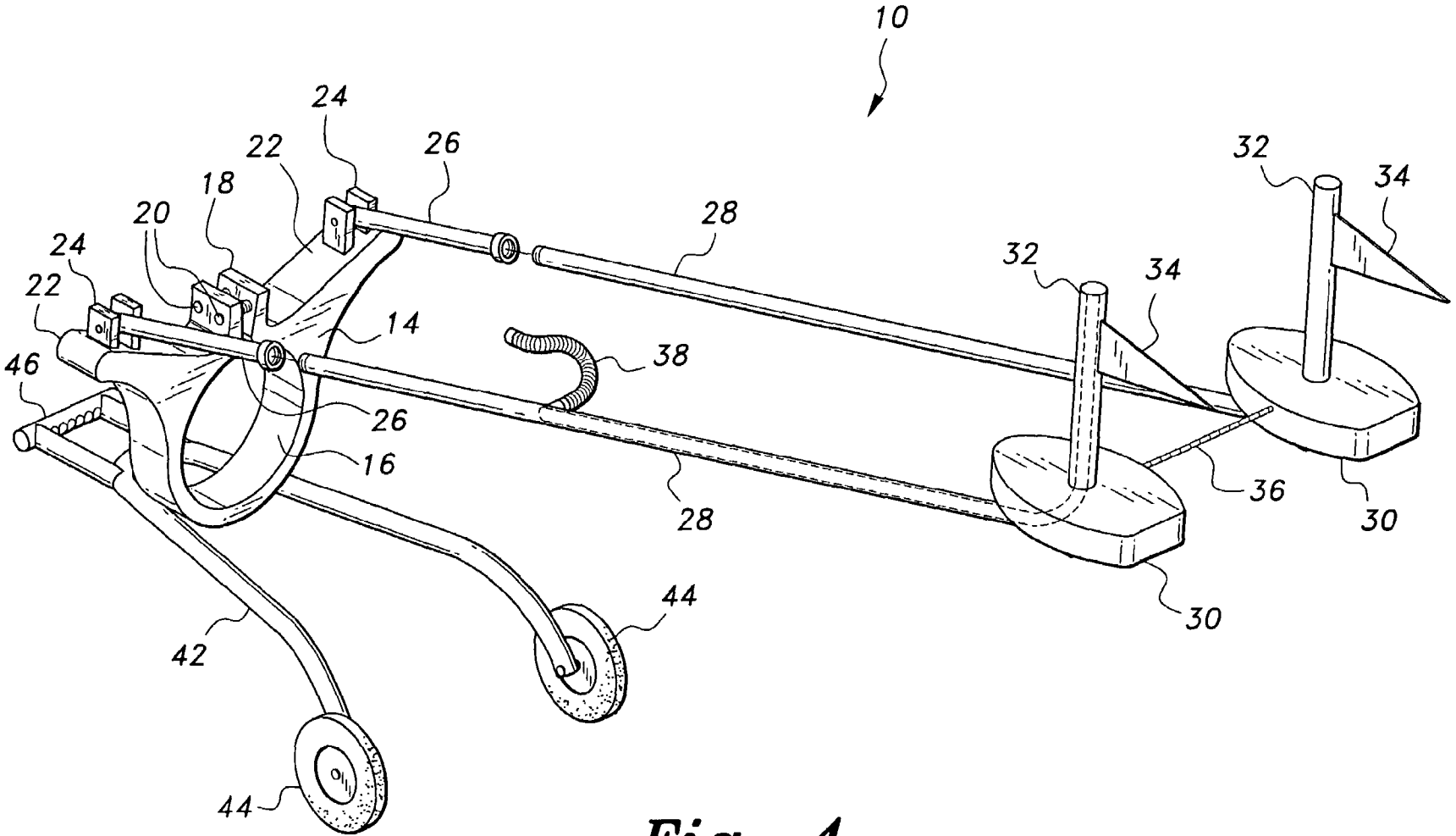
FIG. 4 is a perspective view of the attachment to a sea scooter according to the present invention.

FIG. 4 shows the poles 28 exploded from the arms 26. The poles 28 are detachable to provide for easy storage and transportation of the poles 28 when the attachment 10 is not in use. The poles 28 may be of different lengths according to the needs of different users. For exemplary purposes only, if a user wanted to limit their depth to ten feet, a pair of ten-foot poles 28 would be selected. Similarly, twenty-foot poles 28 could be used if a user wished to go to a depth of twenty feet. Alternatively, the poles 28 may be formed from telescoping members temporarily locked together at a desired length by a band clamp, or by a pin or bolt placed in aligned apertures in the members so that the poles are adjustable in length.

The second end of each pole 28 is pivotally connected to the bottom of a float 30. The floats 30 may be made from hollow plastic, styrofoam, or other buoyant material. Each float 30 has an upwardly extending post 32 with a pennant 34 attached to the post 32. The floats 30, posts 32, and pennants 34 are designed to be visible on the surface of the water when the clamp 14 and poles 28 are submerged, thereby increasing the safety of a user by alerting boats and other swimmers that someone is below the surface. In order to increase stability of the poles 28, the two floats 30 are connected by a support wire 36.

In the embodiment of the attachment 10 shown in FIGS. 1–4, one of the poles 28 is equipped with a flexible breathing tube 38. The flexible breathing tube 38 extends through the post 32, down through the pole 28, and then extends out of the pole 28 so that a user may attach a snorkel 40 to the flexible breathing tube 38. This allows a diver to snorkel to deeper depths than conventional snorkeling equipment permits. Other features of the attachment 10 include a wheeled frame 42 attached below the clamp 14. The wheeled frame 42 has two wheels 44 and a handle 46 that allow a user to easily transport the attachment 10 when not in use in the water.

Figure 2:
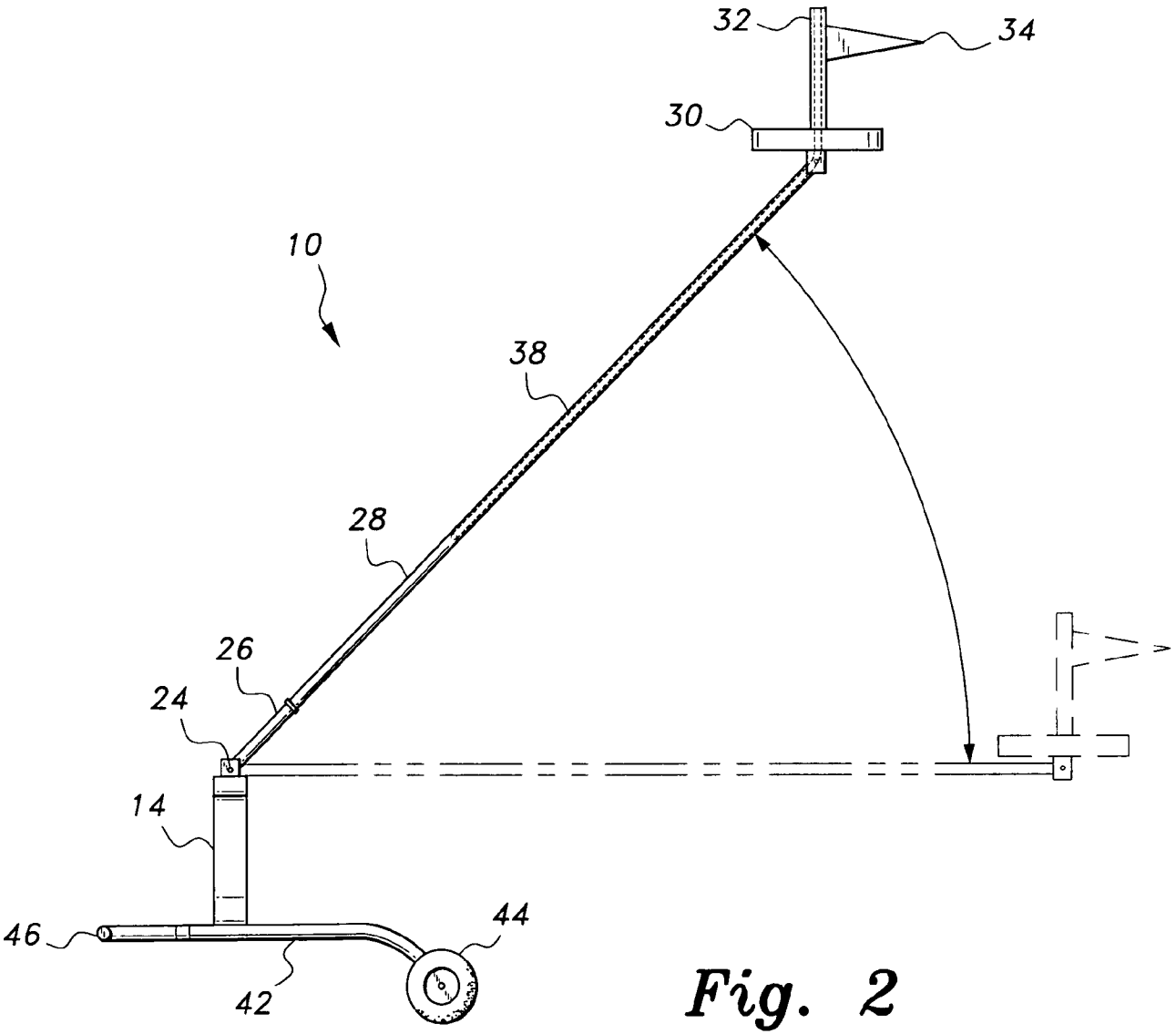
FIG. 2 is a side view of the attachment to a sea scooter according to the present invention.
Figure 3:
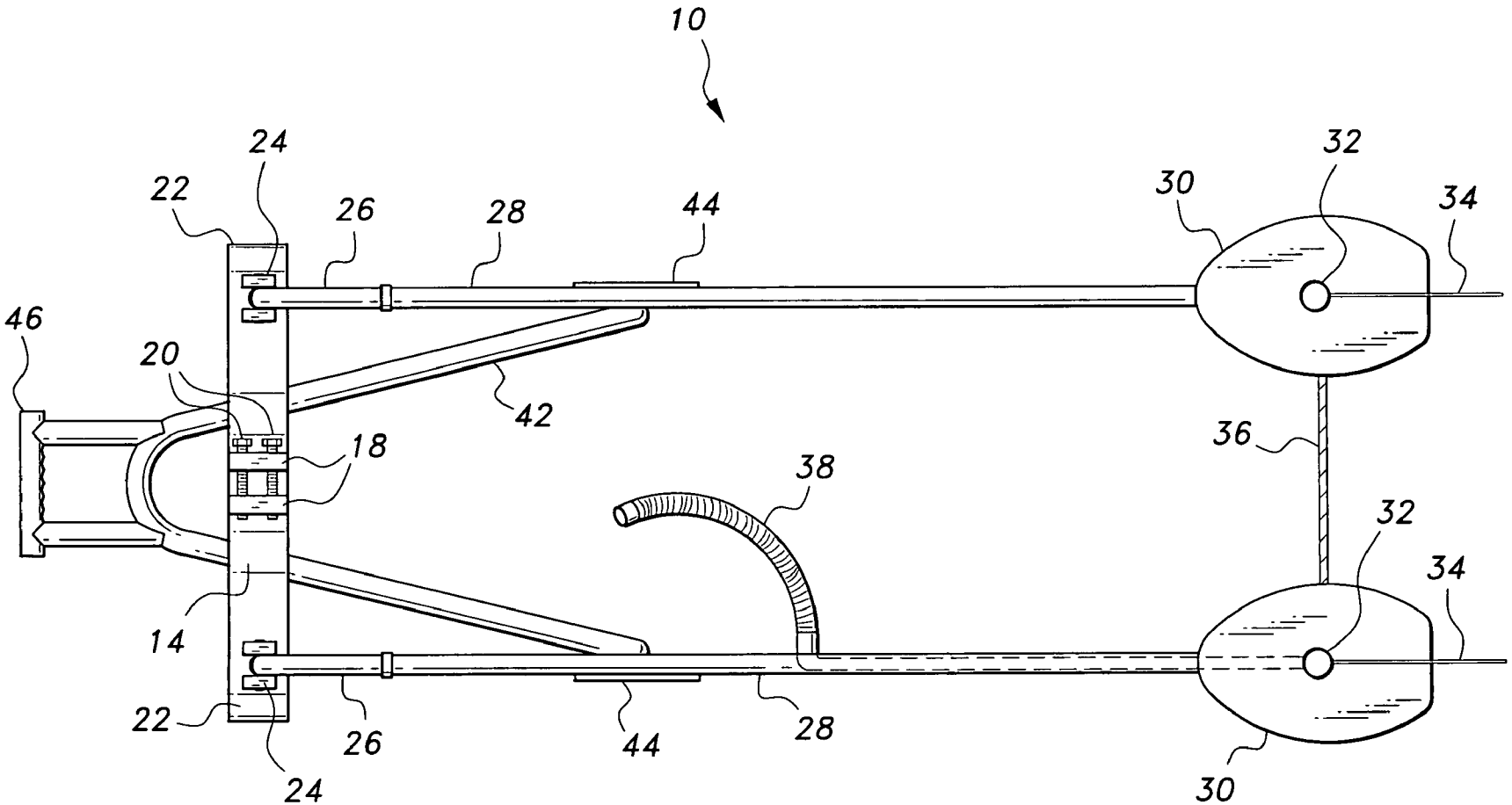
FIG. 3 is a top view of the attachment to a sea scooter according to the present invention.

Referring to FIG. 2, when a user operates a sea scooter 12 in conjunction with the attachment 10, the attachment 10 allows the user to regulate his or her depth. When a user is coasting along the surface, the poles 28 are close to being parallel to the surface of the water and trail behind the user. As a user descends into the water, the poles 28 pivot upward until the poles 28 are in a vertical position. Once the poles 28 have reached the vertical position, the floats 30 prevent the user from going any deeper. In the event of an emergency where a swimmer becomes disoriented, the user could use the poles 28 to climb back to the surface of the water.

Figure 5:
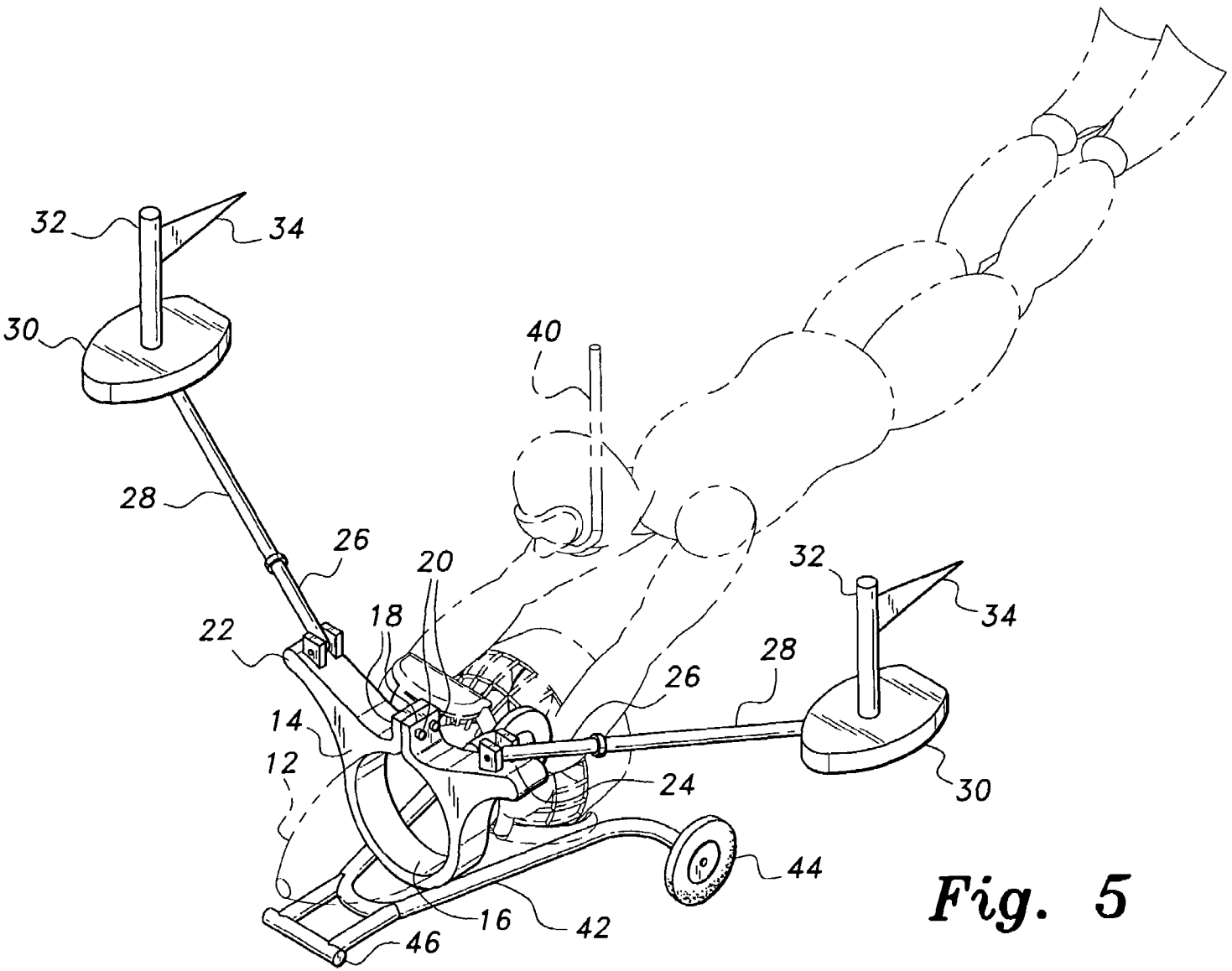
FIG. 5 is a perspective view an embodiment of the attachment to a sea scooter according to the present invention having the stirrups positioned perpendicular to the sea scooter so that the floats extend laterally.

The attachment 10 shown in FIGS. 1–4 features poles 28 that tilt backwards to trail behind the user because the stirrups 24 are longitudinally in alignment with the sea scooter 12. It is also contemplated that the poles 28 may be connected to the wings 22 so that the poles 28 tilt laterally from the scooter 12, as shown in FIG. 5. In FIG. 5, the stirrups 24 are attached perpendicular to the sea scooter 12. Optionally, a bracket (not shown) for holding an air tank may be attached to the clamp 14 to support deeper submergence.

It is to be understood that the present invention is not limited to the embodiments described above, but encompasses any and all embodiments within the scope of the following claims.

I claim:

1. An attachment to a sea scooter, the sea scooter having a circular cross section, the attachment comprising:

a clamp defined by a split ring and a pair of wings, the wings extending to opposite sides of the ring, the ring being dimensioned and configured for encircling a sea scooter;

a pair of elongated poles, each of the wings having one of the poles pivotally attached thereto, respectively; and, a float pivotally attached to each of the poles;

whereby the floats remain on the surface of the sea above the sea scooter, the poles pivoting to adjust for depth of the sea scooter.

2. The attachment to a sea scooter according to claim 1, wherein the floats are made from styrofoam.

3. The attachment to a sea scooter according to claim 1, 2 wherein the floats are hollow plastic members.

4. The attachment to a sea scooter according to claim 2, further comprising:

a hollow post extending from each of the floats; and a pennant attached to each of the posts.

5. The attachment to a sea scooter according to claim 1, wherein at least one of the posts and one of the poles are hollow, the attachment further comprising a flexible breathing tube extending through the hollow post and the hollow pole, the flexible breathing tube exiting the hollow pole adjacent the clamp and being adapted for attachment to a snorkel.

6. The attachment to a sea scooter according to claim 1, wherein each of the poles is hollow.

7. The attachment to a sea scooter according to claim 1, further comprising means for adjusting the length of each of the poles.

8. The attachment to a sea scooter according to claim 1, further comprising a support member extending between the floats.

9. The attachment to a sea scooter according to claim 1, further comprising a wire support member extending between the floats, whereby the poles pivot in unison.

10. The attachment to a sea scooter according to claim 1, further comprising a frame attached to said clamp, the frame having:

a pair of arms and a bight connecting the arms in order to form a U-shaped member, the arms being attached to the clamps;

a pair of wheels attached to the arms.

11. The attachment to a sea scooter according to claim 10, further comprising a handle extending from said frame.

12. The attachment to a sea scooter according to claim 1, wherein said split ring further comprises a pair of opposing flanges, the flanges being bolted together for clamping the split ring around the sea scooter.

13. The attachment to a sea scooter according to claim 1, wherein each of the wings further comprises a stirrup axially aligned with the center of the split ring, the poles being pivotally attached to the stirrups, whereby the poles are adapted for pivoting parallel to the sea scooter.

14. The attachment to a sea scooter according to claim 1, wherein each of the wings further comprises a stirrup aligned normal to with the center of the split ring, the poles being pivotally attached to the stirrups, whereby the poles are adapted for pivoting normal to the sea scooter.

* * * * *